US008136579B2

(12) United States Patent
Riondet et al.

(10) Patent No.: US 8,136,579 B2
(45) Date of Patent: Mar. 20, 2012

(54) HEAT EXCHANGER COMPRISING FLANGES

(75) Inventors: Christian Riondet, Bourgogne (FR); Jean-Marc Lesueur, Reims (FR); Jean-Michel Haincourt, Authon du Perche (FR); Vincent Letellier, Belfort (FR); Alan Day, Reims (FR)

(73) Assignee: Valeo Systems Thermiques, Le Mesnil Saint Denis (FR)

( * ) Notice: Subject to any disclaimer, the term of this patent is extended or adjusted under 35 U.S.C. 154(b) by 1085 days.

(21) Appl. No.: 11/632,792

(22) PCT Filed: Jul. 19, 2005

(86) PCT No.: PCT/FR2005/001841

§ 371 (c)(1), (2), (4) Date: Dec. 27, 2007

(87) PCT Pub. No.: WO2006/018498

PCT Pub. Date: Feb. 23, 2006

(65) Prior Publication Data

US 2008/0169090 A1 Jul. 17, 2008

(30) Foreign Application Priority Data

Jul. 20, 2004 (FR) ..... 04 08018

(51) Int. Cl.
*F28F 7/00* (2006.01)
*F28D 1/00* (2006.01)

(52) U.S. Cl. ..... 165/82; 165/149; 165/81

(58) Field of Classification Search ..... 165/148, 165/149, 81, 82

See application file for complete search history.

(56) References Cited

U.S. PATENT DOCUMENTS

| | | | | |
|---|---|---|---|---|
| 4,719,967 | A * | 1/1988 | Scarselletta | 165/76 |
| 5,404,940 | A * | 4/1995 | van den Nieuwenhuizen et al. | 165/149 |
| 6,129,142 | A * | 10/2000 | Beldam | 165/81 |
| 6,328,098 | B1 * | 12/2001 | Kodumudi et al. | 165/149 |
| 6,412,547 | B1 * | 7/2002 | Siler | 165/81 |
| 7,108,050 | B2 * | 9/2006 | Reichle et al. | 165/81 |
| 7,143,512 | B2 * | 12/2006 | Kroetsch et al. | 29/890.039 |
| 2002/0023735 | A1 * | 2/2002 | Uchikawa et al. | 165/81 |
| 2003/0127214 | A1 * | 7/2003 | Sugimoto et al. | 165/67 |

FOREIGN PATENT DOCUMENTS

| | | |
|---|---|---|
| DE | 19753408 | 6/1999 |
| DE | 10 2005 004907 | 8/2005 |
| EP | 0748995 | 12/1996 |
| EP | 1001241 | 5/2000 |
| EP | 1065464 | 1/2001 |
| EP | 1195573 | 4/2002 |
| WO | WO 03085348 A | 10/2003 |

* cited by examiner

*Primary Examiner* — Tho V Duong

(74) *Attorney, Agent, or Firm* — Howard & Howard Attorneys PLLC

(57) ABSTRACT

The invention relates to a heat exchanger which is intended, for example, for a motor vehicle and which comprises a tube bundle (2) and spacers which are positioned between the tubes of the bundle in order to promote the exchange of heat. The bundle is defined by two end spacers (70, 71). The inventive exchanger also comprises two collector plates through which the ends of the bundle are intended to pass and at least one flange (50, 51) which is disposed on one or the end spacers. Advantageously, the flange comprises at least one expansion zone (80) in order to compensate for the longitudinal expansions thereof, while the transverse section of the flange in the expansion zone is essentially U shaped.

22 Claims, 9 Drawing Sheets

HEAT EXCHANGER COMPRISING FLANGES

The invention relates to a heat exchanger, particularly a heat exchanger intended to be fitted to a motor vehicle.

A conventional heat exchanger has a bundle of tubes delimited by two end tubes. Spacers may also be provided between the tubes in the bundle to improve the heat exchange. An end spacer may be provided on the outer face of each of the end tubes.

The exchanger also has two header plates through which the ends of the bundle of tubes pass. Additionally, a side plate is conventionally placed directly on the end spacer of one of the end tubes.

The side plates of a heat exchanger thus form a distance piece between the header plates to keep a constant separation between the header plates and facilitate the manufacture of the exchanger. They may also be used to support and retain accessory members linked to the heat exchanger, such as a motor-fan unit.

Each side plate generally has a central web, bordered by two longitudinal flanges which extend along the side plate. The central web is generally rectangular and flat. Each longitudinal flange projects from the plane defined by the central web. Thus the cross section of the side plate is substantially U-shaped. The longitudinal flanges are conventionally provided to stiffen and reinforce the associated side plate.

When the exchanger is in operation, variations in the flow of the coolant inside the tubes can give rise to temperature differences which cause thermal expansion in the center of the exchanger. This results in mechanical stresses in the tubes. These stresses can cause the tubes to break.

Moreover, conventional heat exchanger tubes tend to be relatively thin, to limit the production costs of exchangers. The tubes are therefore increasingly less resistant to thermal shocks, with a consequent increase in the risk of breakage as mentioned above.

To limit this risk of breakage, it is preferable for the ends of each side plate to be mechanically separated from the central part of the side plate, in order to prevent the stresses due to thermal expansion from being transmitted to the tubes. For this purpose, there is a known method of forming a transverse cut-out in the side plate in its central part, after the brazing of the exchanger. For example, this cut-out can be formed by sawing. This solution improves the resistance of the tubes to thermal shock, but has the drawback of generating chips which detract from the cleanness of the exchangers and machines, and of decreasing the resistance of the exchanger to vibration and/or pressure alternation.

In other existing embodiments, there is a known way of creating weak areas in the side plate to enable it to expand locally, thus limiting the transmission of stress to the tubes.

For example, patent FR 2 183 375 proposes a lyre-shaped transverse bend in the fixing leg which connects the side plate to the header plate, or directly in the side plate.

Patent application EP 1 195 573 proposes an opening on each side plate such that part of the edge of the opening is located in the vicinity of an edge of the side plate. Additionally, a bend is provided, extending transversely from the aforesaid part of the edge of the opening to the edge of the side plate located in its vicinity.

U.S. Pat. No. 6,328,098 proposes the creation of breaking areas in the form of bends in the central web and/or in the flanges.

These solutions improve the resistance of the tubes to thermal shock for side plates having flanges with a relatively large depth, particularly of the order of 8 mm. However, they are not suitable when the flanges of the side plate are relatively shallow.

The present invention is intended to improve the situation.

For this purpose, the invention proposes a heat exchanger, for a motor vehicle for example, having a bundle of tubes and spacers interposed between the tubes in the bundle to promote heat exchange. The bundle is delimited by two end spacers. The exchanger also has two header plates, designed to have the ends of the bundle passing through them, and at least one side plate positioned on one of the end spacers. Advantageously, the side plate has at least one expansion area to compensate for the longitudinal expansion of the side plate, while the cross section of the side plate in the expansion area is substantially U-shaped.

Optional complementary or substitute characteristics of the circuit element according to the invention are listed below:

- The side plate has a substantially flat central web, bordered by two longitudinal flanges, and the expansion area comprises an opening formed in the central web and two lateral bends pointing towards the inside of the side plate, the lateral bends being positioned on either side of the longitudinal axis of the side plate and each lateral bend extending over part of the flanges and over the corresponding part of the area of connection of the flanges to the central web.
- The lateral bends are substantially symmetrical with each other about the longitudinal axis of the side plate.
- The length of the opening in the expansion area is substantially equal to the length of the lateral bends.
- The point of each lateral bend is substantially located in the center of the expansion area, on the longitudinal axis of the side plate.
- The side plate has a single expansion area and the distance between the center of the expansion area and one of the header plates is substantially in the range from 75 mm to 300 mm.
- The side plate has two expansion areas, each expansion area being located in the vicinity of a header plate.
- The opening in the expansion area is generally rectangular in shape.
- The opening in the expansion area is generally X-shaped.
- The opening is generally M-shaped, the legs of the M following the same direction as the longitudinal axis of the side plate.
- The legs of the M point towards the center of the side plate.
- The legs of the M point towards the neighboring header plate.
- The ratio between the width of the connecting branches of the legs of the M and the length of the side plate is substantially in the range from 0.05 to 0.25.
- The distance between the upper edge of the central point of the M and the lower edge of each lateral point of the M is substantially in the range from −5 mm to +5 mm.
- The distance between the lower edge of the central point and the upper edge of each lateral point is substantially greater than or equal to the width of the connecting branches of the legs of the M, and is substantially less than or equal to the length of the expansion area.
- Each lateral bend comprises on its inner wall a nick whose direction is substantially perpendicular to the plane of the central web, at the point of the lateral bend.
- Each nick has a cross section in the general shape of a V, the point of the V being orientated towards the outside of the side plate.

The ratio between the length of the expansion area and the width of the side plate is substantially in the range from 0.5 to 1.5.

The ratio between the depth of the each lateral bend and the width of the side plate is substantially in the range from 0.05 to 0.3.

Other characteristics and advantages of the invention will be made clear by the following detailed description and the attached drawings, in which.

Figure 1:
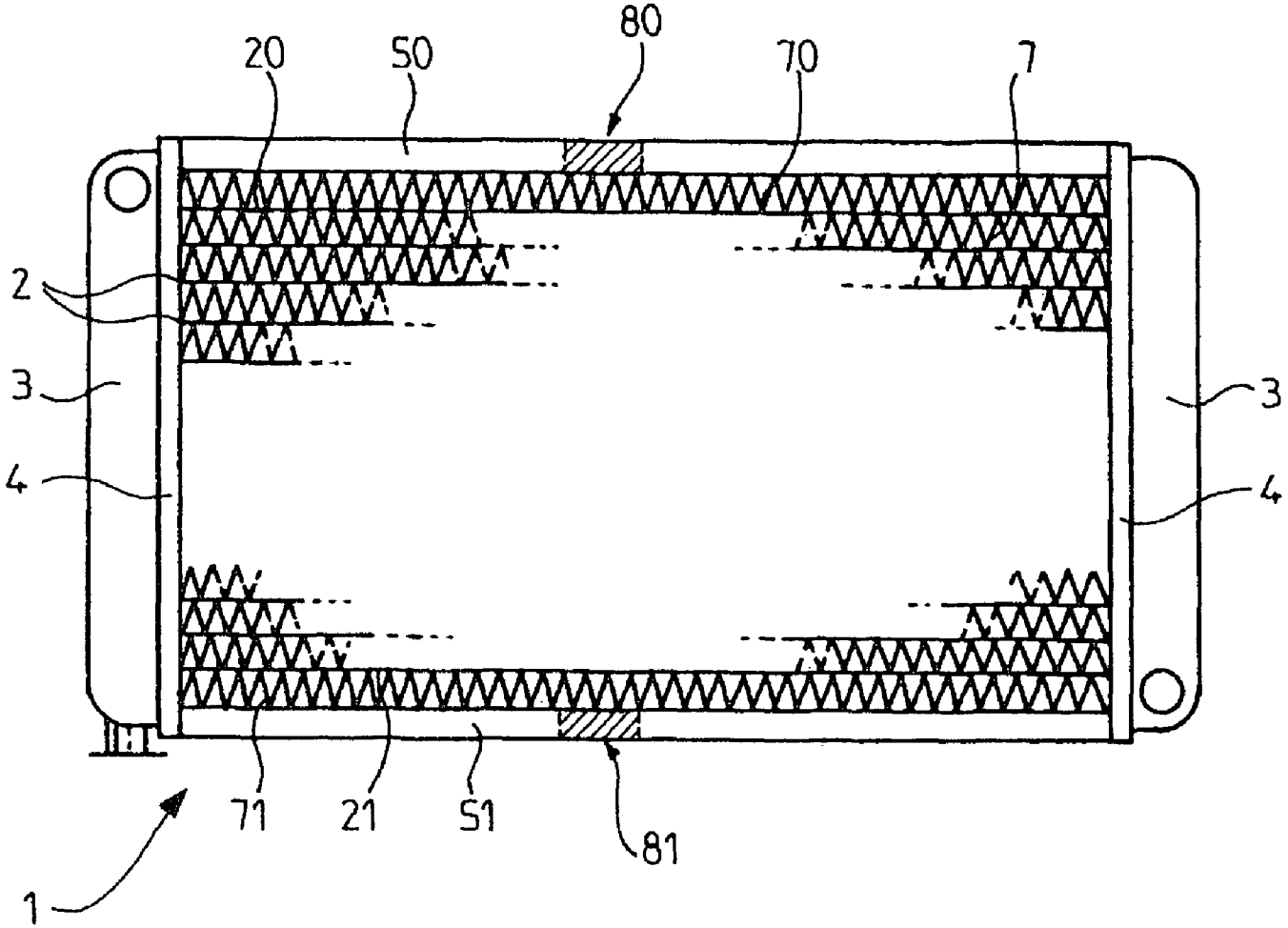
FIG. 1 is a perspective view of a conventional heat exchanger.

FIG. 1 shows a heat exchanger 1, particularly a heat exchanger for a motor vehicle. The heat exchanger 1 has a bundle of tubes 2 which are parallel to each other and are positioned between two header plates 4. Each header plate 4 has one end of the bundle passing through it. Each header plate 4 is covered by a header box 3.

Heat dissipaters in the form of corrugated spacers 7 are fitted between the tubes 2. The heat exchange can take place between the coolant fluid flowing in the tube and the air which passes through the spacers 7. In addition to their function as heat dissipaters, the spacers 7 make it possible to maintain a spacing between the tubes, and limit the deformation of the tubes when a pressurized coolant fluid flows through them.

The tube bundle is delimited by two end tubes 20 and 21, forming the top end tube and the bottom end tube of the bundle respectively. The expressions "top tube" and "bottom tube" are used with reference to the position of the exchanger of FIG. 1. In the position of FIG. 1, the tubes 2, 20 and 21 are substantially horizontal. In a variant, the exchanger can be positioned in such a way that the tubes 2, 20 and 21 are oriented vertically, and in this case the end-tubes are lateral tubes.

The rest of the description refers to the position shown in FIG. 1, by way of non-limiting example. With reference to this position, the end tubes 20 and 21 may be called the "top tube" and "bottom tube" respectively for the sake of clarity.

As shown in FIG. 1, an end spacer 70 is positioned on the outer face of the top tube, and an end spacer 71 is positioned on the outer face of the bottom tube 21. In the rest of the description, these end spacers 70 and 71 may be referred to as the "top spacer" and "bottom spacer" respectively.

The heat exchanger also has at least one side plate positioned on one of the end spacers. Thus, with reference to FIG. 1, the heat exchanger has a side plate 50 positioned on the top spacer 70 and a side plate 51 positioned on the bottom spacer 71. The side plates 50 and 51 are provided to maintain a constant distance between the header plates and to facilitate the manufacture of the exchanger.

The joint between the top tube 20, the spacer 70, the header plates 4 and the side plate 50 is generally made by brazing.

In operation, a coolant fluid enters through one of the header boxes 3 and flows out through the tubes in the bundle. The high temperature of the coolant fluid causes a transfer of heat towards the walls of the tube and to the spacers. The air passing through the spacers can cool the coolant fluid flowing in the tubes.

The tubes then tend to expand longitudinally, under the effect of a high coolant fluid temperature, thus generating high stresses in the area in which the tubes are fixed to the header plates.

By using the side plates 50 and 51, it is possible to maintain a spacing between the header plates, in opposition to the longitudinal expansion of the tubes. However, the temperature of each side plate does not rise at the same rate as that of the corresponding end tube, since the side plate is not in direct thermal contact with the coolant fluid. Each side plate 50 or 51 is actually in contact with the corresponding end spacer 70 or 71, over its whole length, so that the pressure exerted inside the corresponding end tube 20 or 21 is transmitted to the side plate by the end spacer. The side plates therefore exhibit differential expansion which may cause deformation of some parts of the exchanger.

To limit the differential expansion, it is useful to mechanically separate the end parts of the side plate from its central part.

For this purpose, the exchanger 1 has expansion areas, denoted hereafter by the references 80 and 81 respectively, on each side plate 50 and 51. These areas are indicated schematically by the hatched areas in FIG. 1.

Figure 2A:
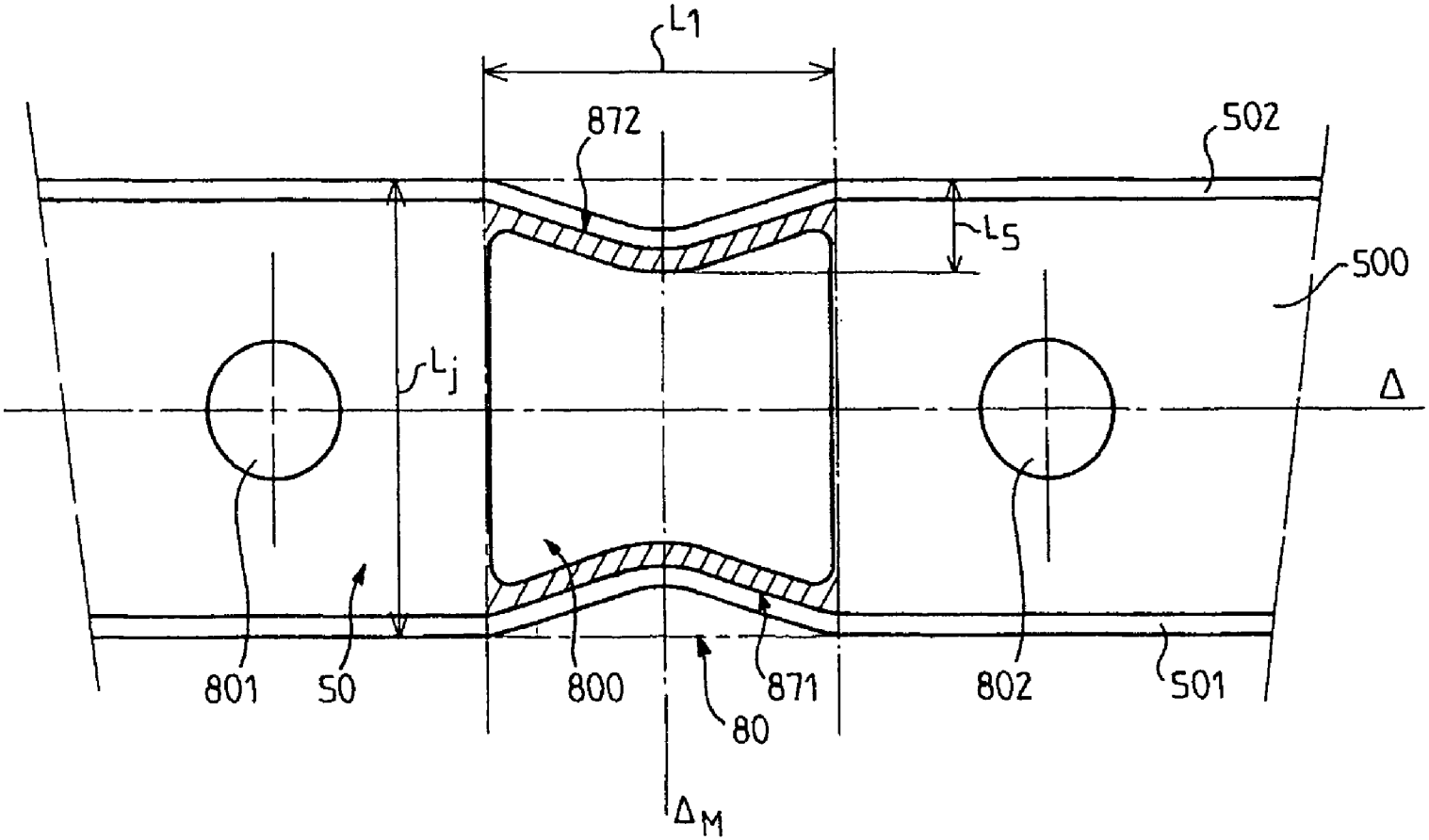
FIG. 2A is a diagram showing a view from above of part of the side plate according to the first embodiment of the invention.

FIG. 2A is a diagram showing a view from above of part of the top side plate 50, according to a first embodiment of the invention. In the rest of the description, the invention will be described with reference to the top side plate 50. However, it is applicable in a similar way to the bottom side plate 51.

The overall cross section of the side plate 50 has the general shape of a U. In particular, it has a substantially flat central web 500, bordered by two longitudinal flanges 501 and 502. The flanges are generally perpendicular to the plane of the central web 500 and are positioned at the edges of the side plate 50. Thus each longitudinal flange 501 and 502 projects from the plane defined by the central web 500. In a known way, the longitudinal flanges have the function of reinforcing and stiffening the side plate 50.

According to one characteristic of the invention, the side plate 50 has an expansion area 80, adapted to compensate for any thermal expansion that may occur longitudinally in the side plate, and the side plate also has a U-shaped cross section in this expansion area. In FIG. 2A, the expansion area is represented by the rectangular area 80 in broken lines.

The expansion area 80 is shaped so as to reduce the stiffness of the side plate under tension, thus also compensating for longitudinal thermal expansion. It is also shaped in such a way that the bending stiffness of the side plate is sufficient to provide acceptable vibration resistance.

For this purpose, the expansion area 80 has an opening 800 formed in the central web, and two lateral bends 871 and 872. Each lateral bend 871 or 872 points towards the inside of the side plate. In particular, the lateral bends 871 or 872 point towards each other. The lateral bends can be symmetrical with each other about the longitudinal axis Δ of the side plate. The opening 800 facilitates the formation of the lateral bends, and the lateral bends make it possible to compensate for the expansion of the side plate.

Each lateral bend 871 or 872 extends along the part of the flange 501 or 502 located in the expansion area, and also along the corresponding part of the area of connection of the flange 501 to the central web 500. Thus the flanges 501 and 502 are connected to the central web 500 in the expansion area 80. The connection area can, for example, have a substantially dihedral shape. Each lateral bend 871 or 872 can also extend along a corresponding part of the central web 500. In particular, the point of each lateral bend 871 or 872 is substantially positioned in the center of the expansion area 80, on the longitudinal axis Δ of the side plate.

The lateral bends 871 and 872 can be produced by deformations of the side plate towards the inside of the side plate, along vertical bend lines passing through the center of the expansion area. In this case, the term "vertical" denotes the direction perpendicular to the plane of the central web 500. For the sake of clarity, this term is used here with reference to the position of the exchanger of FIG. 1.

The deformations 871 and 872 are such that the U-shaped cross section of the side plate is preserved in the expansion area. The dimensions of the U-section of the side plate decrease progressively towards the center of the expansion area, along the longitudinal axis Δ. This U-shape contributes to the stiffness of the side plate and consequently its resistance to vibration.

According to one aspect of the invention, as shown in FIG. 2A, the length of the opening 800 and the length of the lateral bends 871 and 872 can be substantially equal to the length of the expansion area L1.

According to another aspect of the invention, the ratio between the length L1 of the expansion area 80 and the width Lj of the side plate can be substantially in the range from 0.5 to 1.5.

Additionally, the ratio between the depth L5 of each of the lateral bends 871 and 872 and the width Lj of the side plate is preferably substantially in the range from 0.05 to 0.3.

The opening 800 makes it possible to weaken the side plate along the longitudinal axis Δ of the side plate. Thus the side plate is adapted to break under the effect of a relatively weak stress caused by longitudinal expansion.

The lateral bends 871 and 872 of the flanges and of the area of connection of the flanges to the central web, in the expansion area 80, make a further contribution to the longitudinal weakening of the side plate. They also make it possible to maintain a satisfactory bending stiffness of the side plate, in the plane perpendicular to the plane of the central web 500. This stiffness is necessary for the resistance of the side plate to vibration.

This solution is particularly suitable for side plates provided with shallow flanges, particularly those rising about 1 to 3 mm above the central web. This is because, in the case of a side plate provided with shallow flanges, it is difficult to consider cutting out the flanges to contribute to the weakening of the side plate, because of the complexity and cost of these operations. Furthermore, it is difficult to form openings in the surfaces of the flanges to weaken them in such side plates, because of their shallowness.

As well as being particularly suitable for shallow flanges, the exchanger according to the invention makes it possible to preserve the U-section of the side plate over its whole length, and therefore to obtain satisfactory bending stiffness in the expansion area 80.

As shown in FIG. 2A, the opening 800 according to the first embodiment of the invention can be substantially rectangular in shape, with its width substantially equal to the width Lj of the side plate 50.

The longitudinal edges of the opening 800 can be curved inwards slightly, under the effect of the deformations applied to form the lateral bends 871 and 872.

According to the invention, the side plate 50 can comprise a single expansion area 80. In this case, the distance between the center of the expansion area 80, passing through the axis $\Delta_M$, and one of the header plates 4 is substantially in the range from 75 mm to 300 mm.

In a variant, the side plate 50 can comprise two expansion areas 80. In this case, each expansion area 80 is located in the proximity of one of the header plates.

Figure 2B:
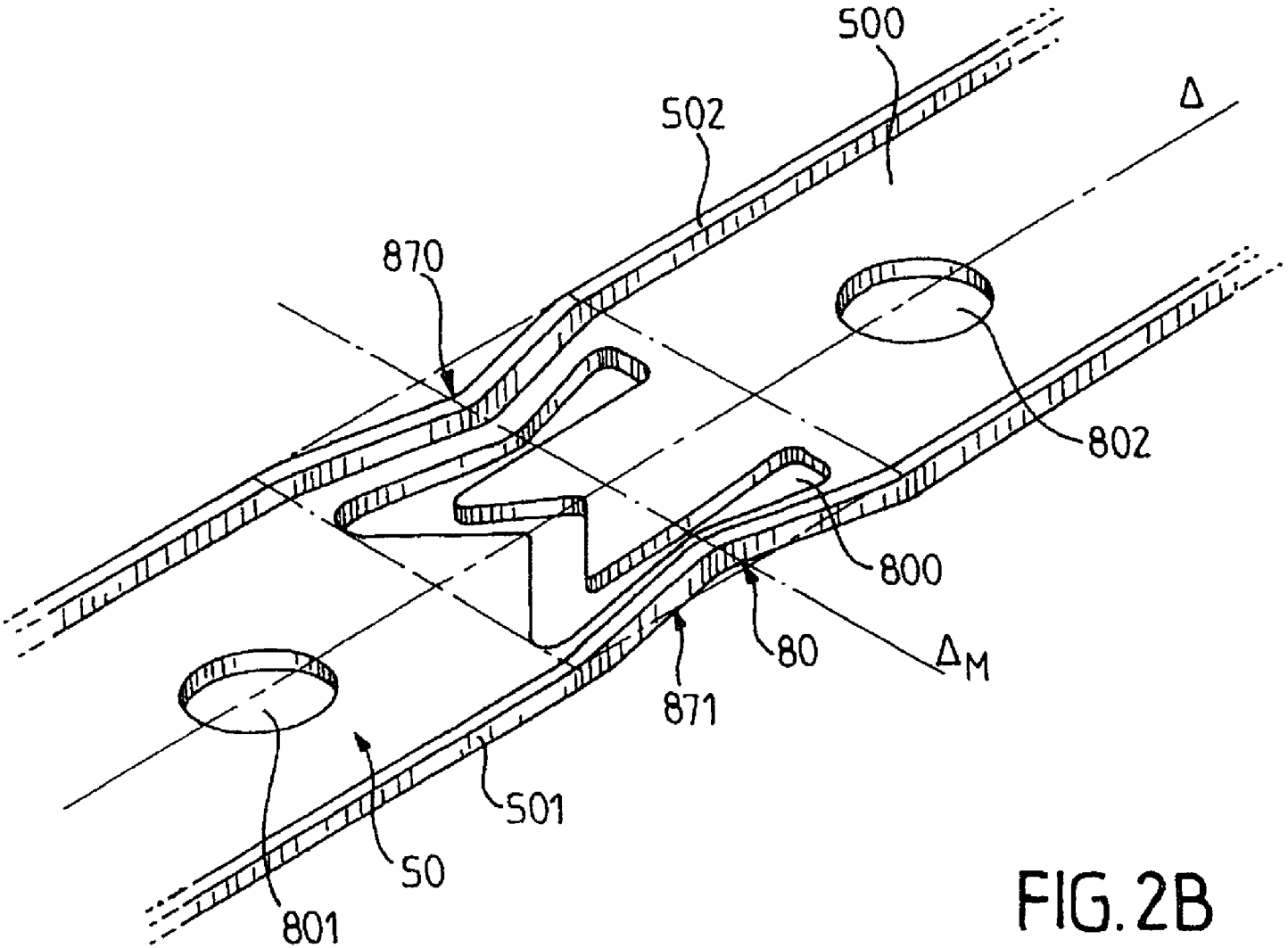
FIG. 2B is a perspective view of part of a side plate according to a second embodiment of the invention.
Figure 3:
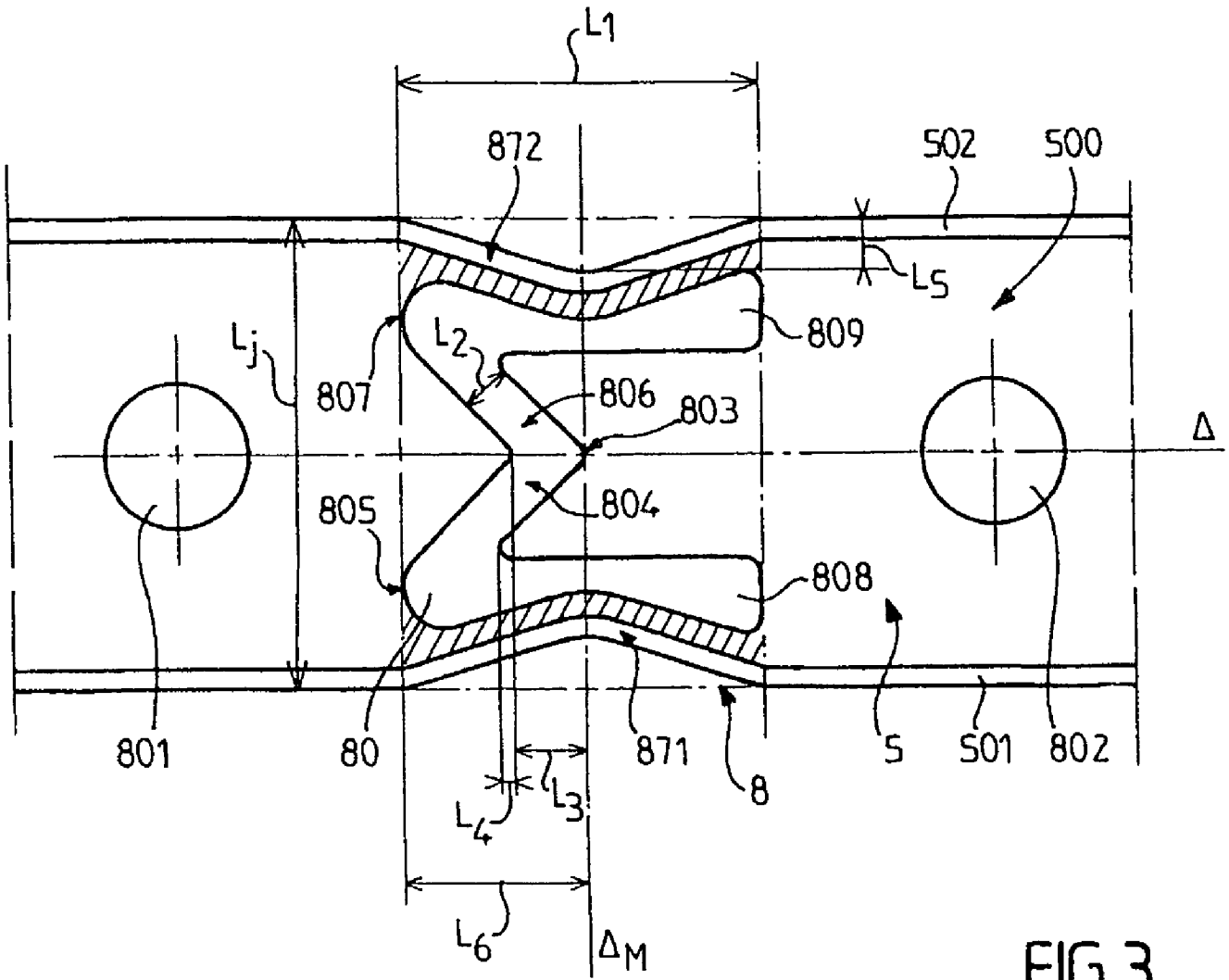
FIG. 3 is a diagram showing a view of part of the side plate according to the second embodiment of the invention.

Reference will now be made to FIGS. 2B and 3 which show a second embodiment of the invention. According to this second embodiment of the invention, the opening 800 can have a general shape in the form of an M, whose legs 808 and 809 are generally oriented along the longitudinal axis Δ of the side plate.

Figure 4A:
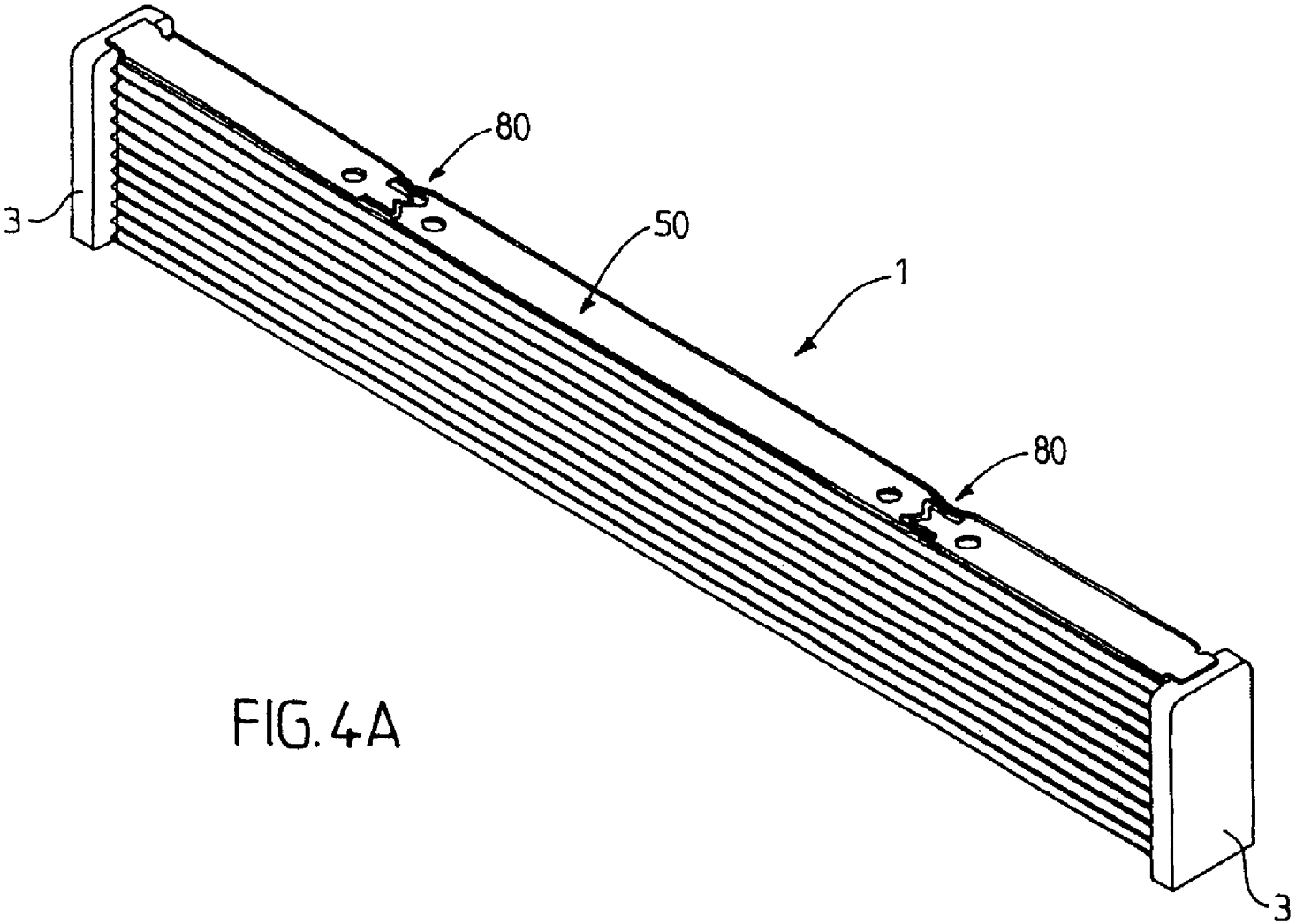
FIG. 4A is a diagram showing a perspective view of a heat exchanger according to the second embodiment of the invention.
Figure 4B:
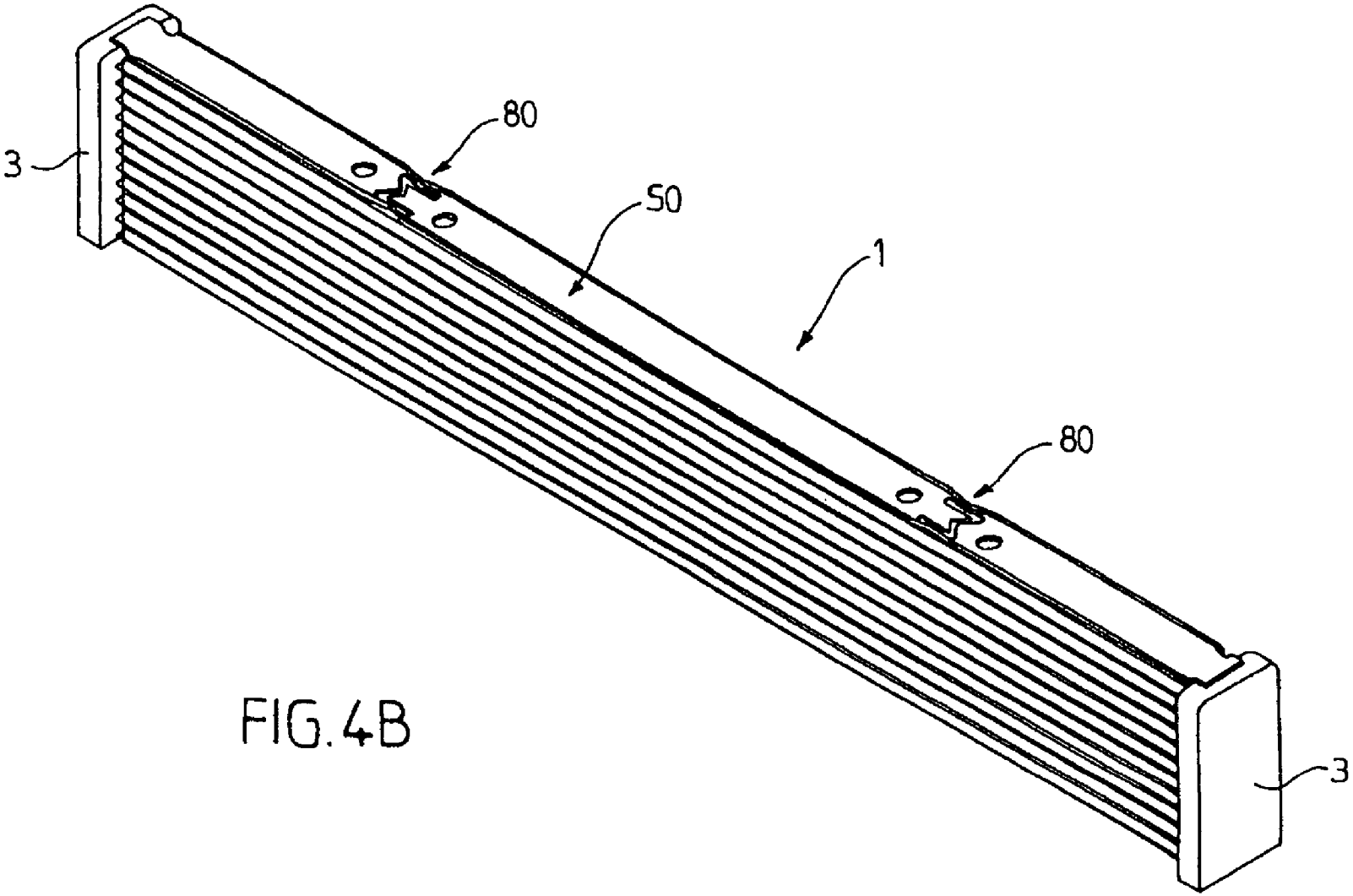
FIG. 4B is a diagram showing a perspective view of a variant embodiment of the heat exchanger of FIG. 4A.

FIGS. 4A and 4B show perspective views of a heat exchanger according to the second embodiment of the invention. In these figures, the top side plate 50 of the heat exchanger has two expansion areas 80.

In this embodiment, the legs of the M of each expansion area can be oriented towards the header plate located in its proximity, as shown in FIG. 4A.

In a variant, the legs of the M of each of the expansion areas 80 can be oriented towards the center of the side plate, as shown in FIG. 4B.

FIG. 3 is a diagram showing a view from above of part of the side plate 50, showing an expansion area 80 according to the second embodiment of the invention. With reference to this figure, the M-shaped opening 800 has a central point 803 and two lateral points 805 and 807.

The legs 808 and 809 are connected by two branches 804 and 806. These connecting branches also delimit the central point 803 of the M. According to one aspect of the invention, the ratio between the width L2 of each connecting branch 804 and 806 and the width Lj of the side plate is substantially in the range from 0.05 to 0.25.

According to a complementary aspect of the invention, the distance L4 between the upper edge of the central point 803 and the lower edge of each lateral point 805 and 807 is substantially in the range from −5 mm to +5 mm.

Additionally, the distance L6 between the lower edge of the central point 803 and the upper edge of each lateral point 805 and 807 is substantially greater than or equal to the width L2 of the branches of the central point 803, and is substantially less than or equal to the length L1 of the expansion area 80.

These dimensions enable the shape of the opening 800 to be adapted to the width of the side plate and to keep the spacer bends pressed against the tube during brazing.

Additionally, positioning holes 801 and 802 can be provided on either side of each of the expansion areas 80. These positioning holes enable the side plate to be held in the tool, thus preventing any variation in the length of the side plate during the forming of the opening 800.

The width of the M-shaped opening 800 is preferably substantially smaller than the width Lj of the side plate. Thus a peripheral strip of material is delimited between each edge of the side plate and the corresponding longitudinal edge of the M, in the web part 500 of the expansion area 80. The strips of material are indicated by hatching in FIG. 3. These peripheral strips of material enable the bending stiffness of the side plate 50 to be adapted, for example, to the width of the side plate.

These strips of material are preferably in the range from approximately 0 mm to 3 mm.

Figure 5:
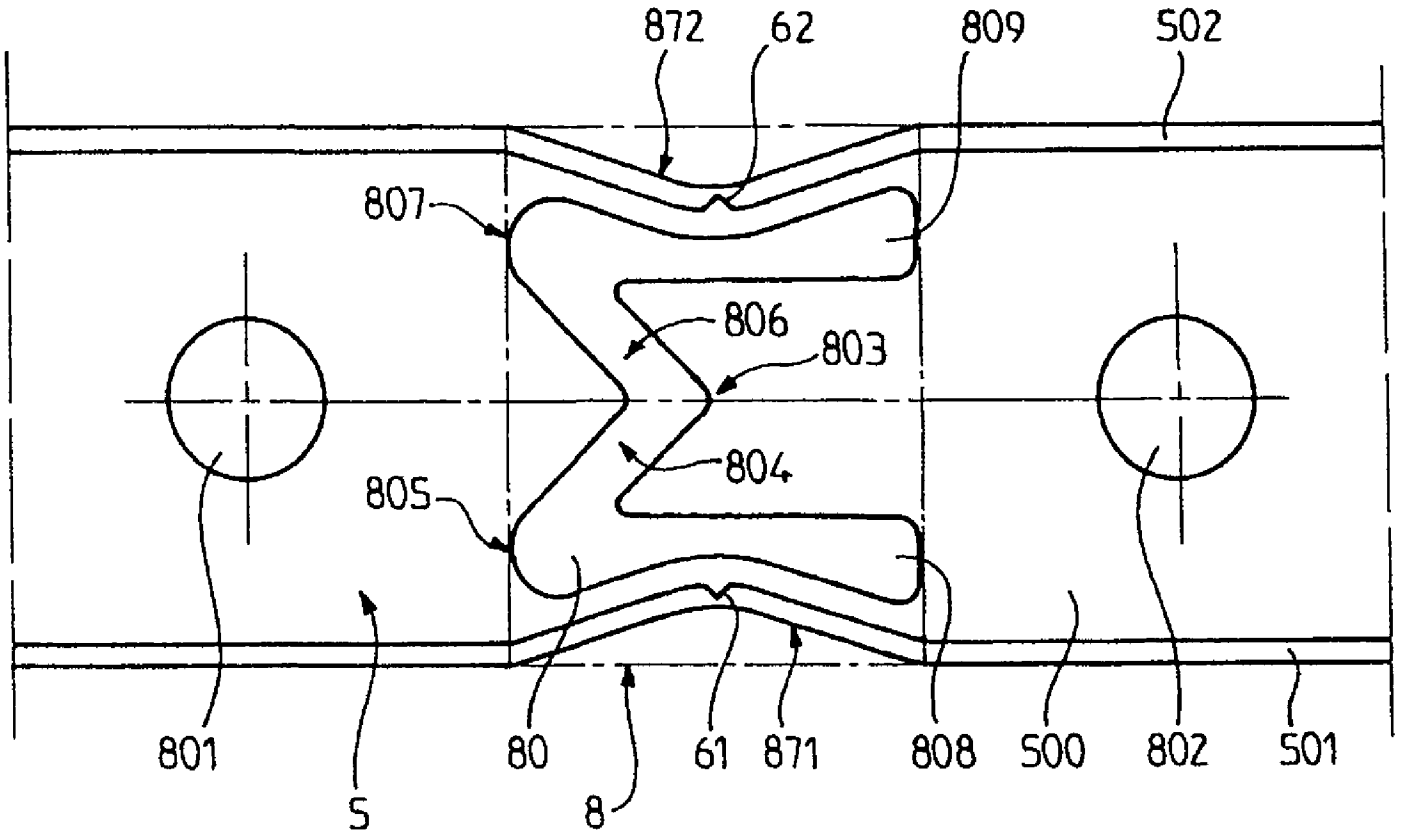
FIG. 5 is a diagram showing a view from above of part of the side plate according to the second embodiment of the invention.

FIG. 5 is a diagram showing a view from above of part of the side plate according to a variant of the second embodiment of the side plate. In this variant, a nick 61 or 62 can be provided in the inner wall of each lateral bend 871 and 872, at the point of the lateral bend. More precisely, each nick extends along the bending line of the corresponding lateral bend, on the inner wall of the latter. Each nick 61 and 62 preferably has a V-shaped cross section, the point of the V pointing towards the outside of the side plate. The nicks 61 and 62 facilitate the bending of the flanges 501 and 502 in case of longitudinal expansion.

The opening 800 and the lateral bends 871 and 872 of the expansion area 80 weaken the central web 500 to compensate for a longitudinal expansion of the side plate, while contributing to the bending stiffness in the plane perpendicular to the plane of the web.

Additionally, the lateral bends 871 and 872 of the expansion area can keep the top spacer pressed against the top tube during brazing.

According to the second embodiment of the invention, the lateral points 805 and 807 of the M-shaped opening also help to keep the top spacer 70 pressed against the top tube during brazing.

Figure 6:
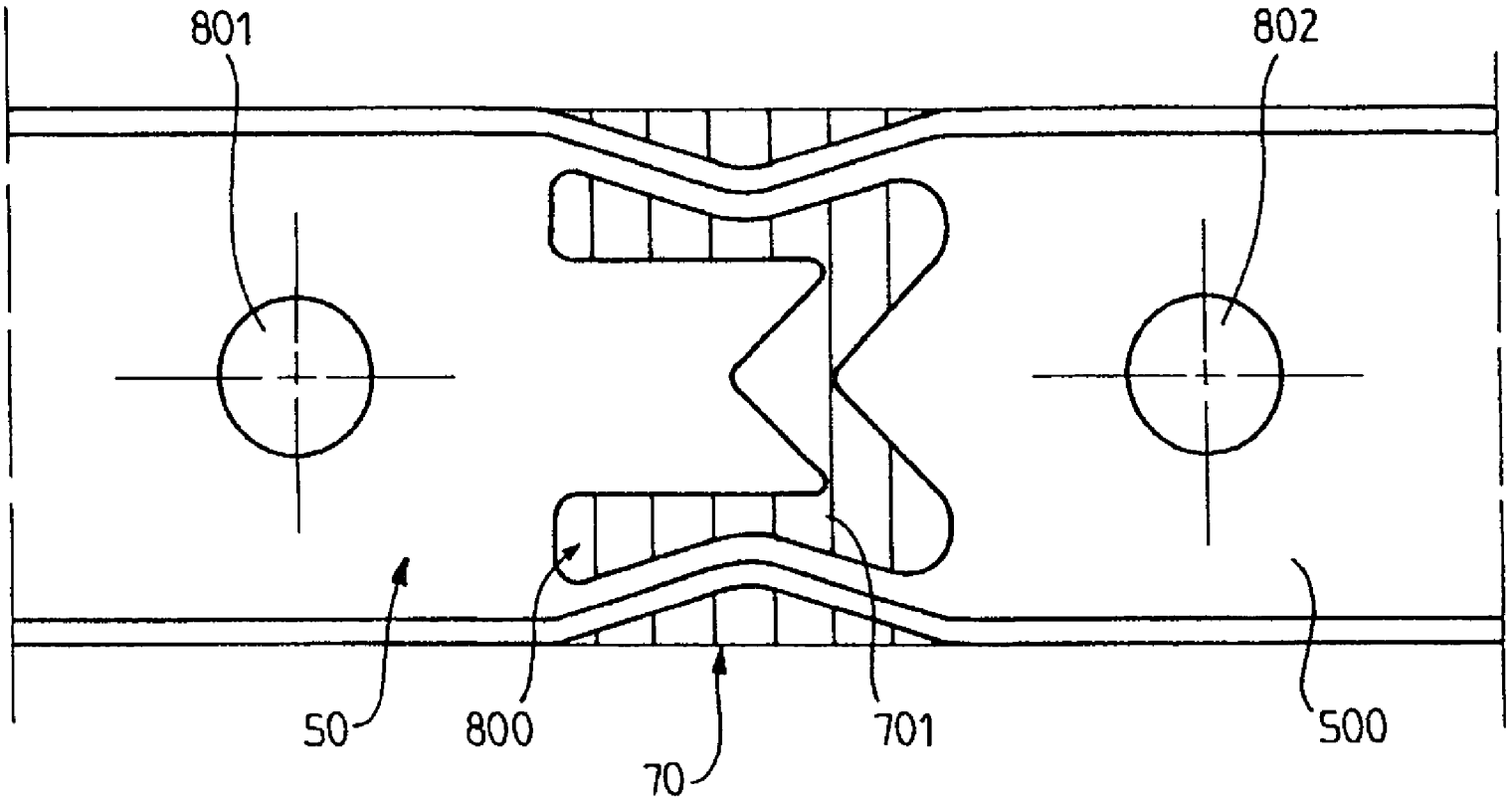
FIG. 6 is a diagram showing a view from above of part of the side plate attached to the end spacer according to the second embodiment of the invention.

Reference will now be made to FIG. 6, which is a partial view of the side plate 50 attached to the spacer 70. According to another aspect of the invention, it is also possible to avoid brazing the spacer bend 701, located between the upper edge and the lower edge of the central point 803, to the side plate, in order to improve the expansion compensation. The provision of an unattached spacer bend increases the flexibility of the side plate, while maintaining a satisfactory resistance of the tube to alternating pressure.

It is also possible to avoid brazing the lateral bends 871 and 872 of the side plate to the spacers, which also increases the flexibility in expansion.

During brazing, the heated end tubes can expand under the effect of the heating. The side plates can then undergo differential expansion with respect to the end tubes. However, this differential expansion is compensated by the expansion area 80, according to the invention, which is deformed in such a way that the stresses are not transferred to the ends of the exchanger.

The side plate according to the invention can be formed by profiling. In a variant, it can be produced by stamping. The opening 800 can be produced by making a cut-out in the side plate in the expansion area.

The lateral bends 871 and 872 can be formed by deforming the flanges and the area of connection of the flanges to the web towards the inside of the side plate.

In order to assemble the heat exchanger according to the invention, the tube bundle is first assembled, with spacers 7 fitted between the tubes 2, and the spacers 70 and 71 positioned on the end tubes 20 and 21 respectively. The tubes of the bundle are then engaged in the header plates 4, after which the side plates 50 and 51 are fixed to the header plates. The assembled exchanger is then brazed. The header boxes 3 can be fitted after the exchanger has been brazed. In a variant, they can be brazed with the tube bundle.

In the second embodiment, the lateral points 805 and 807 of the M-shaped opening 800 keep the top spacer 70 pressed against the tube during brazing.

As mentioned above with reference to FIG. 6, it is possible to leave one spacer bend 701 unattached between the V-shapes of the M-shaped opening. It is also possible to avoid brazing the flanges of the side plate to the spacers.

According to the invention, it is possible to adapt the shape of the lateral bends and the dimensions of the expansion area 80 so that the lateral bends break during the use of the exchanger, thus enabling the end of the side plate to be completely separated from its central part. This produces an effect similar to that which would be achieved by sawing through the side plate according to the prior art.

Figure 7:
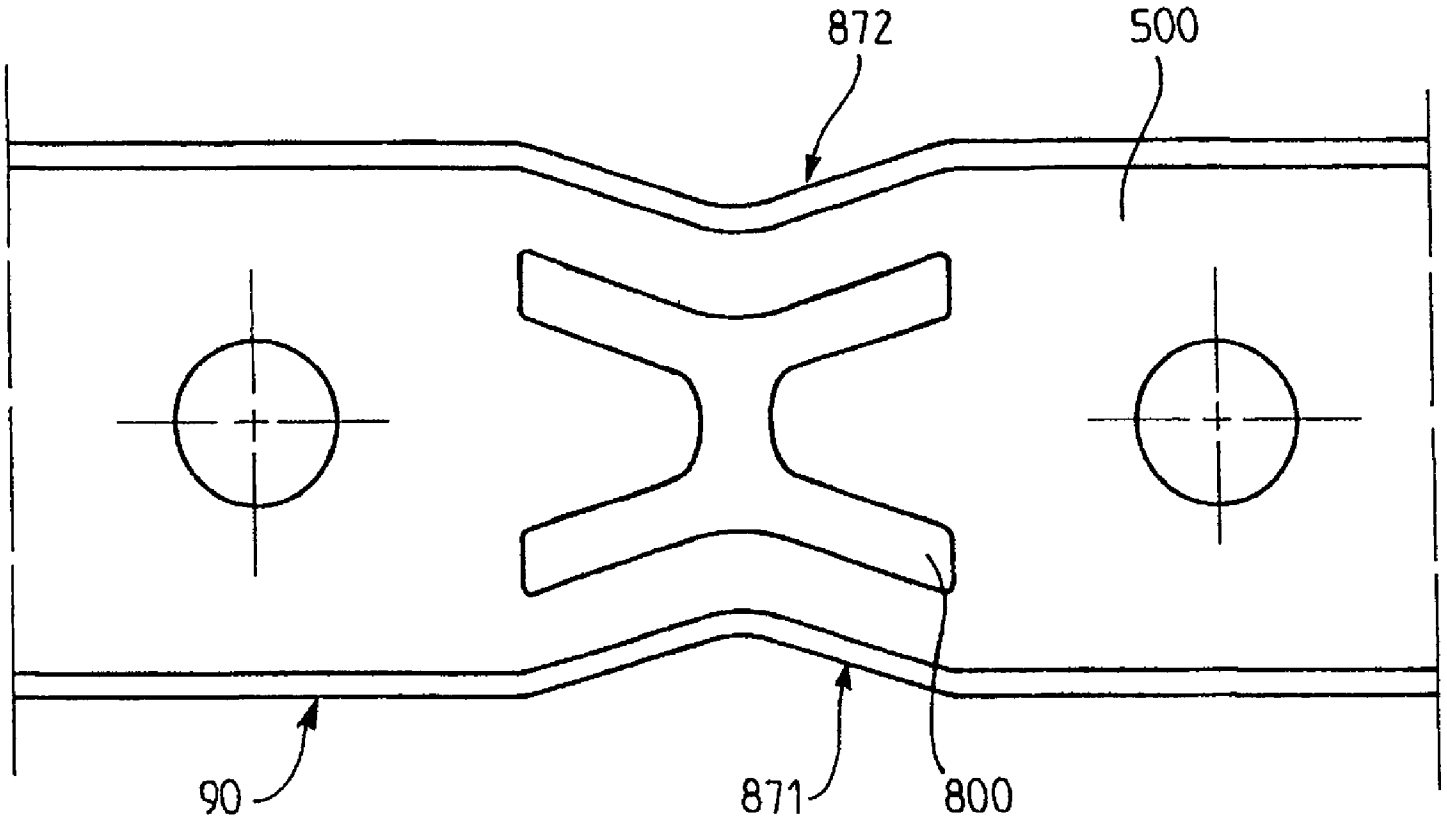
FIG. 7 is a diagram showing a view from above of part of the side plate according to another embodiment of the invention.

Clearly, the present invention is not limited to the embodiments described above. It incorporates all variant embodiments that may be devised by those skilled in the art. In particular, the invention is not limited to an opening 800 having the general shape of a rectangle or to an opening having the general shape of an M. Other shapes can be envisaged. In particular, an opening 800 having the general shape of an "X", as shown in FIG. 7, could be used for the application of the invention.

The invention claimed is:

1. A heat exchanger for a motor vehicle having a bundle of tubes (2) and spacers interposed between the tubes in the bundle to promote heat exchange, the bundle being delimited by two end spacers (70, 71), the exchanger also having two header plates, designed to have the ends of the bundle passing through them, and at least one side plate (50, 51) positioned on one of the end spacers, characterized in that the side plate has at least one expansion area (80) to compensate for the longitudinal expansion of the side plate, and in that the cross section of the side plate in the expansion area is substantially U-shaped, wherein the side plate has a substantially flat central web (500), bordered by two longitudinal flanges (501, 502), the flanges (501, 502) being connected to the central web (500) in the expansion area (80), and wherein the expansion area (80) comprises an opening (800) formed in the central web (500) and two lateral bends (871, 872) pointing towards an inside of the side plate, the lateral bends being positioned on either side of a longitudinal axis of the side plate (a) and each lateral bend extending over part of the flanges and over a corresponding part of the area of connection of the flanges to the central web.

2. The heat exchanger as claimed in claim 1, characterized in that the lateral bends are substantially symmetrical with each other about the longitudinal axis of the side plate (A).

3. The heat exchanger as claimed in claim 1, characterized in that a length of the opening (800) in the expansion area (80) is substantially equal to a length of the lateral bends (871, 872).

4. The heat exchanger as claimed in claim 2, characterized in that a point of each lateral bend is substantially located in a center of the expansion area, on the longitudinal axis of the side plate (A).

5. The heat exchanger as claimed in claim 1, characterized in that the side plate has a single expansion area (80) and in that the distance between the center of the expansion area and one of the header plates is substantially in the range from 75 mm to 300 mm.

6. The heat exchanger as claimed in claim 1, characterized in that the side plate has two expansion areas, each expansion area being located in the vicinity of the header plate.

7. The heat exchanger as claimed in claim 1, characterized in that the opening (800) in the expansion area is generally rectangular in shape.

8. The heat exchanger as claimed in claim 1, characterized in that the opening (800) in the expansion area is generally X-shaped.

9. The heat exchanger as claimed in claim 1, characterized in that the opening is generally M-shaped, with legs of the M (808, 809) following a same direction as the longitudinal axis of the side plate Δ.

10. The heat exchanger as claimed in claim 9 considered in combination with claim 6, characterized in that the legs of the M point towards the center of the side plate.

11. The heat exchanger as claimed in claim 9 considered in combination with claim 6, characterized in that the legs of the M point towards the neighboring header plate.

12. The heat exchanger as claimed in claim 9, characterized in that a ratio between a width (L2) of the connecting branches (804, 806) of the legs of the M and a length (L1) of the side plate is substantially in the range from 0.05 to 0.25.

13. The heat exchanger as claimed in claim 9, characterized in that a distance (L4) between the upper edge of the central point (803) of the M and the lower edge of each lateral point of the M (805, 807) is substantially in the range from −5 mm to +5 mm.

14. The heat exchanger as claimed in claim 9, characterized in that a distance (L6) between the lower edge of the central point (803) and the upper edge of each lateral point (805, 807) is substantially greater than or equal to a width (L2) of the connecting branches (804, 806) of the legs of the M, and is substantially less than or equal to the length (L1) of the expansion area (80).

15. The heat exchanger as claimed in claim 1, characterized in that each lateral bend (871, 872) comprises on its inner wall a nick (61, 62) whose direction is substantially perpendicular to a plane of the central web, at the point of the lateral bend.

16. The heat exchanger as claimed in claim 15, characterized in that each nick (61, 62) has a cross section in the general shape of a V, the point of the V being oriented towards the outside of the side plate.

17. The heat exchanger as claimed in claim 1, characterized in that a ratio between a length (L1) of the expansion area and a width of the side plate (Lj) is substantially in the range from 0.5 to 1.5.

18. The heat exchanger as claimed in claim 1, characterized in that a ratio between a length (L5) of each lateral bend and a width (Lj) of the side plate is substantially in the range from 0.05 to 0.3.

19. The heat exchanger as claimed in claim 3, characterized in that a length of the opening (800) in the expansion area (80) is substantially equal to a length of the lateral bends (871, 872).

20. The heat exchanger as claimed in claim 3, characterized in that a point of each lateral bend is substantially located in a center of the expansion area, on the longitudinal axis of the side plate (A).

21. The heat exchanger as claimed in claim 6, characterized in that the opening (800) in the expansion area is generally rectangular in shape.

22. The heat exchanger as claimed in claim 4, characterized in that each lateral bend (871, 872) comprises on its inner wall a nick (61, 62) whose direction is substantially perpendicular to a plane of the central web, at the point of the lateral bend.

* * * * *

UNITED STATES PATENT AND TRADEMARK OFFICE

CERTIFICATE OF CORRECTION

PATENT NO. : 8,136,579 B2
APPLICATION NO. : 11/632792
DATED : March 20, 2012
INVENTOR(S) : Christian Riondet et al.

It is certified that error appears in the above-identified patent and that said Letters Patent is hereby corrected as shown below:

On the Title page of Patent, Section (73) Assignee:
Delete "Valeo Systems Thermiques" and insert therein --Valeo Systemes Thermiques--.

Column 10, line 13, after "as claimed in claim," delete "3" and insert therein --2--.

Signed and Sealed this
Eighteenth Day of September, 2012

David J. Kappos

David J. Kappos
*Director of the United States Patent and Trademark Office*